US007918155B2

(12) United States Patent
Lapp et al.

(10) Patent No.: US 7,918,155 B2
(45) Date of Patent: Apr. 5, 2011

(54) PISTON WITH A COOLING GALLERY

(75) Inventors: Michael T. Lapp, Bloomfield, MI (US); Juan Gildemeister, Howell, MI (US); Steve Walker, Talbott, TN (US); Stan Sorin, Farmington Hills, MI (US)

(73) Assignee: Mahle International GmbH, Stuttgart (DE)

( * ) Notice: Subject to any disclaimer, the term of this patent is extended or adjusted under 35 U.S.C. 154(b) by 509 days.

(21) Appl. No.: 11/955,073

(22) Filed: Dec. 12, 2007

(65) Prior Publication Data

US 2009/0151555 A1 Jun. 18, 2009

(51) Int. Cl.
*F02F 3/00* (2006.01)
*F02F 3/22* (2006.01)

(52) U.S. Cl. ..... 92/231; 92/159; 92/208; 29/888.042

(58) Field of Classification Search ..... 92/159, 92/186, 208, 231, 260; 29/888.042
See application file for complete search history.

(56) References Cited

U.S. PATENT DOCUMENTS 4,286,505 A * 9/1981 Amdall ..... 92/186
5,070,768 A 12/1991 Goncalves et al.
6,155,157 A 12/2000 Jarrett
6,279,455 B1 8/2001 Kruse
6,327,962 B1 12/2001 Kruse
6,526,871 B1 3/2003 Zhu et al.
6,588,320 B2 7/2003 Gaiser et al.
6,698,391 B1 3/2004 Kemnitz
6,763,758 B2 * 7/2004 Kemnitz et al. ..... 92/186
6,862,976 B2 3/2005 Gaiser et al.

FOREIGN PATENT DOCUMENTS

DE 10209168 9/2003
FR 2582351 A1 * 11/1986
WO WO-2006034862 4/2006
WO WO 2006034862 A1 * 4/2006

* cited by examiner

*Primary Examiner* — Thomas E Lazo
(74) *Attorney, Agent, or Firm* — Rader, Fishman & Grauer PLLC

(57) ABSTRACT

A piston for an internal combustion engine is provided. The piston crown includes an interior surface that defines at least in part a cooling gallery and a cooling gallery surface within the piston. An annular surface may defines at least in part an annular passageway that allows fluid communication between an outer surface of the piston and the cooling gallery. Opposing annular surfaces may be abutted with a predetermined force, thereby limiting fluid flow from the cooling gallery to an outer surface of the piston. Further, an annular surface may extend into the cooling gallery to form a deflector along the cooling gallery surface, thereby limiting fluid flow from the cooling gallery to an outer surface of the piston.

25 Claims, 5 Drawing Sheets

PISTON WITH A COOLING GALLERY

TECHNICAL FIELD

The present disclosure relates to a piston for an internal combustion engine, and lubrication systems for pistons.

BACKGROUND

Internal combustion engine manufacturers are constantly seeking to increase power output of their products. One method of generally increasing engine power is to increase the compression ratio of the engine. Raising the compression ratio of an engine also generally raises the pressure and temperature within the combustion chamber during operation. Accordingly, various piston components must be capable of withstanding the increased stress of such operational conditions over the life of the engine.

To reduce the operating temperatures of piston components, a cooling gallery may be provided about a perimeter of the piston. Crankcase oil may be introduced to the cooling gallery, and may be distributed about the cooling gallery by the reciprocating motion of the piston, thereby reducing the operating temperature of the piston.

The heated oil may exit the cooling gallery through one or more holes that allow the oil to return to the crankcase. For example, oil may exit the cooling gallery though an opening adjacent the cylinder wall, between the piston head and the piston skirt. Some of this oil may become trapped between the piston skirt and the cylinder, and may further slip between the piston oil control rings and the cylinder wall into the combustion chamber. As a result, oil may be burned during the combustion process, resulting in increased oil consumption, build-up of carbon deposits in the engine, and fouling of engine emissions.

Accordingly, there is a need for a piston that minimizes the amount of oil that escapes from the cooling gallery into the combustion chamber.

DETAILED DESCRIPTION

Figure 1:
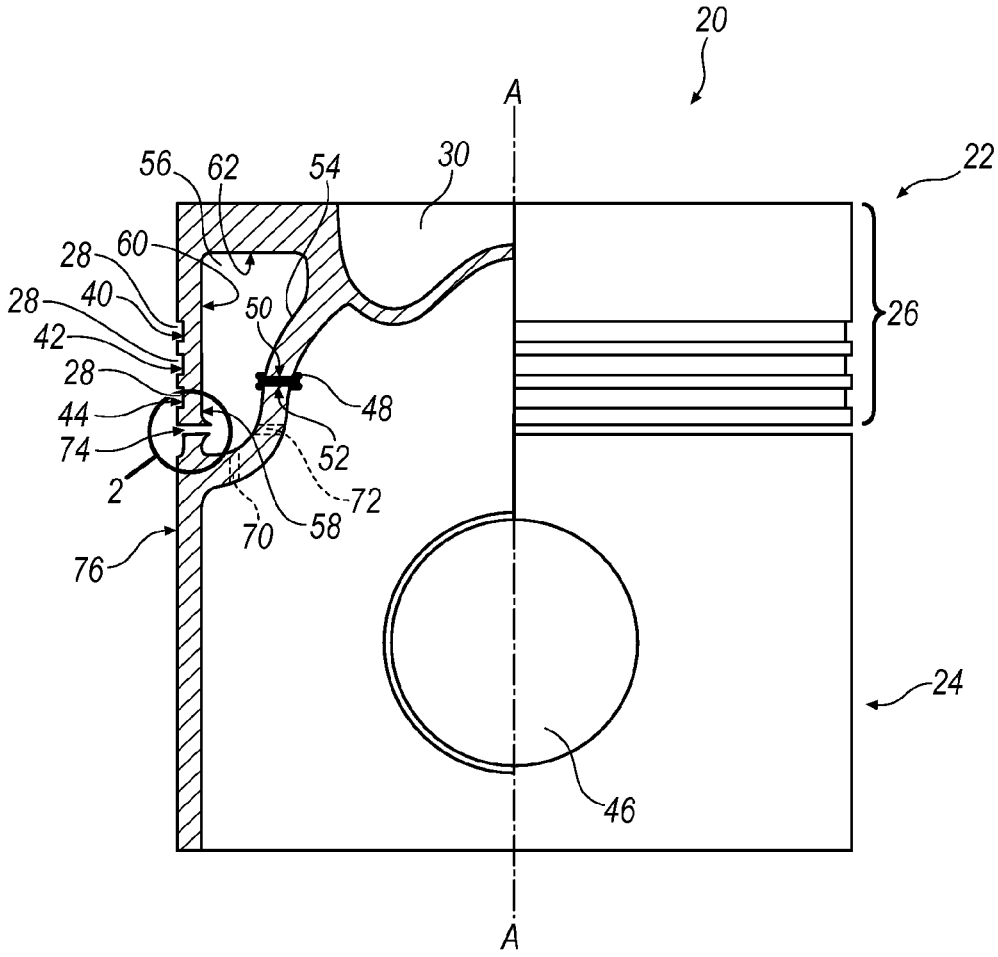
FIG. 1 is a partial cross sectional view of a piston including a deflector located inside of a cooling gallery.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

Moreover, there are a number of constants introduced in the discussion that follows. In some cases illustrative values of the constants are provided. In other cases, no specific values are given. The values of the constants will depend on characteristics of the associated hardware and the interrelationship of such characteristics with one another as well as environmental conditions and the operational conditions associated with the disclosed system.

According to various exemplary illustrations described herein, a piston including a cooling gallery and an annular passageway is provided. The piston may include a piston crown and a piston skirt. The piston crown includes a crown annular surface and a crown interior surface. The piston skirt includes a skirt annular surface and a skirt interior surface. The crown interior surface cooperates with the skirt interior surface to define a cooling gallery within the piston. The crown annular surface and the skirt annular surface cooperate to form an annular passageway that allows for fluid communication between an outer surface of the piston and the cooling gallery. At least one of the crown annular surface and the skirt annular surface extend inwardly towards an axis of the piston and into the cooling gallery to form a deflector. The deflector may be formed along the cooling gallery surface adjacent the annular passageway, thereby limiting fluid flow from the cooling gallery to the outer surface of the piston.

In an alternative illustration, a piston is provided that has a crown and a skirt that are mechanically secured together. The crown includes a crown annular surface and a crown interior surface, and the skirt includes a skirt annular surface and a skirt interior surface, wherein the crown and skirt interior surfaces cooperate to define a cooling gallery within the piston. The crown and the skirt are abutted against each other with a predetermined force maintaining the abutment therebetween and generally limiting fluid flow from the cooling gallery to an outer surface of the piston.

A method of assembling a piston is also disclosed. The method generally includes providing a piston crown having a crown annular surface and a crown interior surface, and providing a piston skirt including a skirt annular surface and a skirt interior surface. The method further includes securing the piston crown to the piston skirt, wherein the crown interior surface cooperates with the skirt interior surface to define a cooling gallery and a cooling gallery surface within the piston, and abutting the crown annular surface and the skirt annular surface with a predetermined force. The predetermined force generally maintains the crown annular surface and skirt annular surface in abutment, thereby generally limiting fluid flow from the cooling gallery to an outer surface of the piston.

Turning now to the drawings and in particular to FIG. 1, an exemplary piston 20 for an internal combustion engine is disclosed. In the illustration of FIG. 1, a piston crown 22 is fixedly joined to a piston skirt 24. The piston crown 22 includes a ring belt portion 26 and a combustion bowl 30. The ring belt portion 26 includes a plurality of ring grooves 28 for receiving a piston ring (not shown). In particular, the ring belt portion 26 may include a first ring groove 40, a second ring groove 42 and a third ring groove 44. The third ring groove 44 may have an oil control ring (not shown) disposed therein.

The piston skirt 24 includes a wrist bore 46 for receiving a wrist pin (not shown) to affix piston 20 to a connecting rod (not shown).

The piston crown 22 and the piston skirt 24 are fixedly joined to one another by a friction weld 48. Although FIG. 1 illustrates a friction weld, it is understood that the piston crown 22 and the piston skirt 24 may be fixedly joined by any method that will secure the piston crown 22 to the piston skirt 24, such as, but not limited to, beam welding, laser welding or mechanical fastening with one or more bolts, screws, etc. Alternatively or in addition to these methods of joining piston crown 22 and piston skirt 24, the piston crown 22 and the piston skirt 24 may each include complementary threading (not shown) to allow the piston crown 22 and piston skirt 24 to be threadingly engaged, thereby fixing the piston crown 22 and the piston skirt 24 together.

The piston crown 22 includes an upper mating surface 50, and the piston skirt 24 includes a lower mating surface 52. The upper mating surface 50 cooperates with the lower mating surface 52 to define an inner cooling gallery wall 54 of a cooling gallery 56. The cooling gallery 56 is provided to facilitate cooling of the piston 20.

By fixedly joining the piston crown 22 and the piston skirt 24, the piston 20 is formed as a one-piece monobloc piston. That is, the piston crown 22 is unitized with the piston skirt 24, such that the piston skirt 24 is immovable relative to the piston crown 22. Piston crown 22 and piston skirt 24 may be constructed from different materials. For example, the piston crown 22 may be formed of a different grade steel material than the piston skirt 24. More specifically, the steel used for the piston crown 22 may include different mechanical properties, e.g., yield point, tensile strength or notch toughness, than the piston skirt 24. It should be noted that while FIG. 1 illustrates the piston crown 22 and the piston skirt 24 as separately formed parts that are fixedly joined together, the piston 20 may also be a unitary or one-piece design. That is, the piston crown 22 and the piston skirt 24 may be formed integrally as a single piece.

The cooling gallery 56 is located within the piston 20 and includes a cooling gallery surface 58. The cooling gallery surface 58 is defined at least in part by an annular ring belt wall 60 and a combustion bowl wall 62. In the illustration as shown in FIG. 1, the cooling gallery 56 is generally closed. That is, the cooling gallery 56 is bounded by the inner cooling gallery wall 54, the combustion bowl wall 62 and the annular ring belt wall 60. The cooling gallery 56 also includes a fluid inlet aperture 70, a fluid outlet aperture 72 and an annular passageway 74.

The fluid inlet aperture 70 is in communication with one or more nozzles (not shown) in operation within the piston 20 for directing fluid, e.g., crankcase oil, into the cooling gallery 56. The fluid cools the inside walls of the cooling gallery 56 with the reciprocating motion of the piston 20 when in operation with an internal combustion engine (not shown). Fluid introduced into the cooling gallery 56 is permitted to escape through one or more fluid outlet apertures 72 for drainage back into the crank case of the engine (not shown).

In the embodiment as illustrated in FIG. 1, the annular passageway 74 extends from a generally cylindrical outer piston surface 76 at the ring belt portion 26 to the cooling gallery 56. The annular passageway 74 extends completely around the circumference of the piston 20. Although FIG. 1 illustrates the annular passageway 74 extending from below the third ring groove 44, it should be noted that the annular passageway 74 may also extend from between the second ring groove 42 and the third ring groove 44, or between the first ring groove 40 and the second ring groove 42 as well.

FIG. 2 is an enlarged view of the annular passageway 74. The annular passageway 74 extends between the outer piston surface 76 and the cooling gallery surface 58, thereby allowing fluid communication between the outer piston surface 76 and the cooling gallery surface 58. The annular passageway includes a height H that may be any distance that is convenient. In one example, height H may be between about 0.10 millimeters and about 0.5 millimeters. The annular passageway 74 includes an upper annular passageway surface 80 and a lower annular passageway surface 82.

One or more deflectors 84 may be formed along the cooling gallery surface 58 to limit fluid flow from the cooling gallery 56 to the outer piston surface 76. A deflector 84 is formed when at least one of the upper annular passageway surface 80 and the lower annular passageway surface 82 extends inwardly beyond the cooling gallery surface 58, and into the cooling gallery 56. That is, the deflector 84 projects inwardly from the cooling gallery surface 58 towards the axis A-A of the piston 20.

The deflectors 84 generally create a discontinuity on the surface of cooling gallery 56, thereby re-directing fluid flow from the cooling gallery 56 away from the annular passageway 74 and limiting the amount of fluid that reaches the outer piston surface 76. That is, a raised area 86 of the deflector 84 that protrudes inwardly from the cooling gallery surface 58 directs fluid away from the annular passageway 74, and back into the cooling gallery 56. More specifically, as best seen by FIG. 2B, the raised area 86 re-directs a fluid path 96 away from the annular passageway 74. Thus, the deflector 84 restricts the amount of fluid that is trapped between the outer piston surface 76 and a cylinder (not shown). Accordingly, an amount of oil or fluid that may reach the combustion bowl 30 is reduced.

Figure 2A:
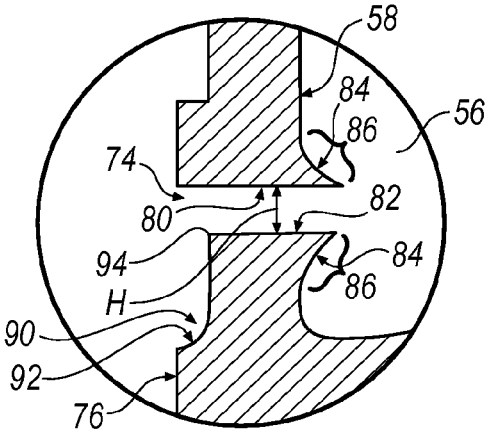
FIG. 2A is an enlarged perspective view of Region 2 in FIG. 1.
Figure 2B:
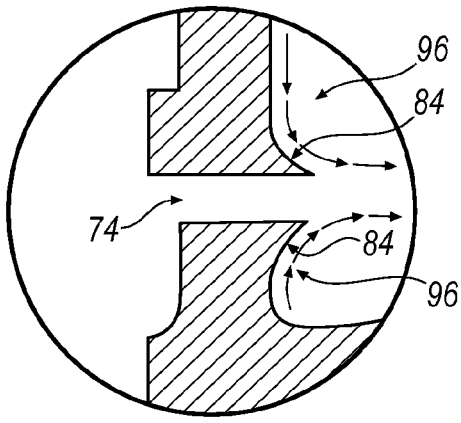
FIG. 2B is an enlarged perspective view of Region 2 in FIG. 1, including a fluid path.

FIG. 2A illustrates a generally J-shaped groove 90 defining a ledge 92 along the outer piston surface 76. The generally J-shaped groove 90 is located between an outer edge 94 of the lower annular passageway surface 82 and the outer piston surface 76. The J-shaped groove 90 retains fluid that may escape out through the annular passageway and become trapped between the outer piston surface 76 and a cylinder (not shown), thereby improving lubrication between piston 20 and the cylinder.

In the example illustrated in FIGS. 2A and 2B, the deflector 84 includes a generally curved profile. That is, the raised area 86 generally provides a smooth transition away from the general contour of the cooling gallery surface 58 for fluid to flow along, thus directing fluid away from the annular passageway 74. The raised area 86 may cooperate with one of the upper annular passageway surface 80 and the lower annular passageway surface 82 to form a generally triangular profile that extends into the cooling gallery 56, as shown in FIGS. 2A and 2B. It should be noted that while FIGS. 2A and 2B illustrates both of the upper annular passageway surface 80 and the lower annular passageway surface 82 including a deflector 84, only one of the upper annular passageway surface 80 and the lower annular passageway surface 82 may include a deflector as well.

Figure 3:
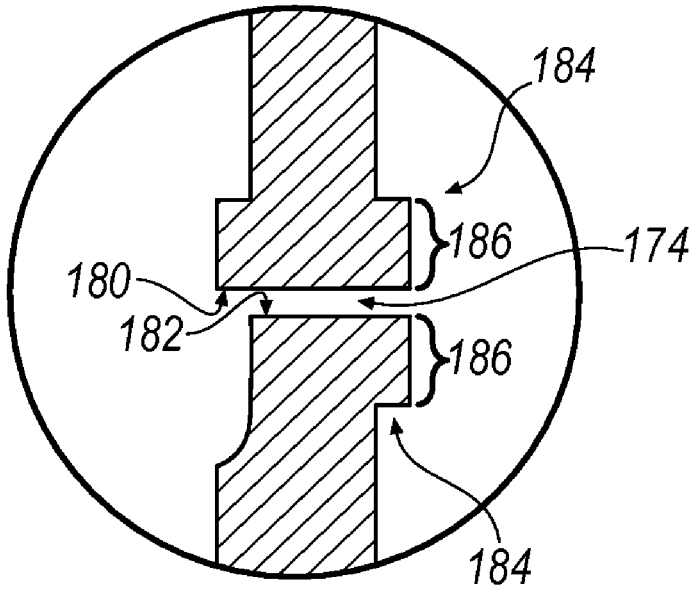
FIG. 3 is an alternative illustration of the deflector illustrated in FIG. 2A.
Figure 4:
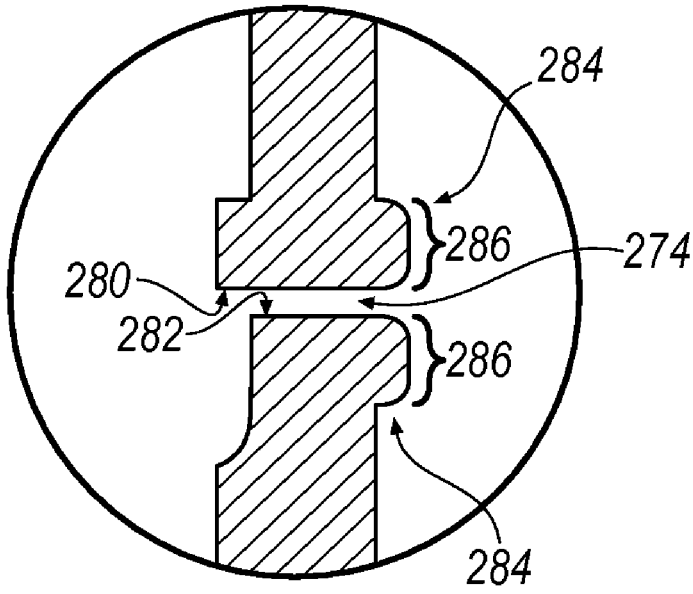
FIG. 4 is an alternative illustration of the deflector illustrated in FIG. 2A.

Although FIGS. 2A and 2B illustrate deflectors 84 as having a generally triangular profile, and a curved profile for raised portion 86, any profile that creates a discontinuity on the cooling gallery surface 58 and/or restricts fluid flow to the outer piston surface 76 by directing fluid flow away from annular passageway 74 may be employed. Merely as examples, FIGS. 3 and 4 show alternative illustrations of the deflector 184. More specifically, FIG. 3 includes a raised area 186 that cooperates with the upper or lower annular surfaces 180, 182 to form a generally rectangular deflector 184. Additionally, FIG. 4 includes a raised area 286 that cooperates with the upper or lower annular surfaces 280, 282 to form a deflector 284 having a generally semi-circular profile. Any other profile that generally directs fluid flow along the cooling gallery surface 58 may be employed.

Figure 5:
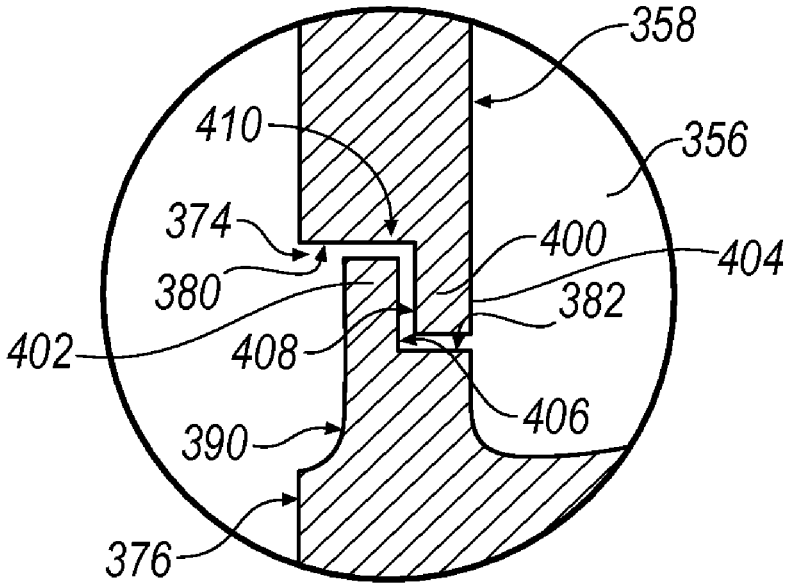
FIG. 5 is an alternative illustration of FIG. 2A.

FIG. 5 is an alternative illustration of an annular passageway 374. The annular passageway 374 includes an angled passageway or baffle 410 that is used to limit the amount of fluid that is able to reach the outer piston surface 376. Accordingly, baffle 410 may further restrict the amount of fluid that reaches the outer piston surface 376, or combustion bowl 30. The upper annular passageway surface 380 includes a crown interior projection 400, and the lower annular passageway surface 382 includes a skirt interior projection 402. The skirt interior projection 402 is inverted relative to the crown interior projection 400. Moreover, the crown interior projection 400 corresponds with the skirt interior projection 402, and the skirt interior projection 402 corresponds with the crown interior projection 400.

Thus, the baffle 410 is formed by both of the skirt interior projection 402 and the crown interior projection 400. More specifically, FIG. 5 illustrates an outer surface 408 of the crown interior projection 400 and an inner surface 406 of the skirt interior projection 402 forming the baffle 410. The baffle 410 generally impedes fluid flow toward outer piston surface 376. For example, either of crown interior projection 400 or skirt interior projection 402 may act as a plate or a wall that deflects the flow of fluid from the cooling gallery 356 to the outer piston surface 376. Additionally, as shown in FIG. 5, the J-shaped groove 390 is included along the outer piston surface 376.

FIG. 5 illustrates an inner surface 404 of the crown interior projection 400 that forms a portion of the cooling gallery surface 358. However, an inner surface 406 of the skirt interior projection 402 may also form a portion of the cooling gallery 356 as well, i.e., skirt interior projection 402 may be positioned adjacent cooling gallery 56 and on an interior side of crown interior projection 400. In the illustration as shown, both the skirt interior projection 402 and the crown interior projection 400 include a generally rectangular profile. However, it should be noted that any profile, shape, or configuration of crown interior projection 400 and/or skirt interior projection 402 that forms a generally angled or undulating portion of the annular passageway 374 may be employed. Merely by way of example, either crown or skirt interior projections 400, 402 may include a triangular or a semi-circular shaped protrusion to create an undulating or angled portion of annular passageway 374.

Figure 6:
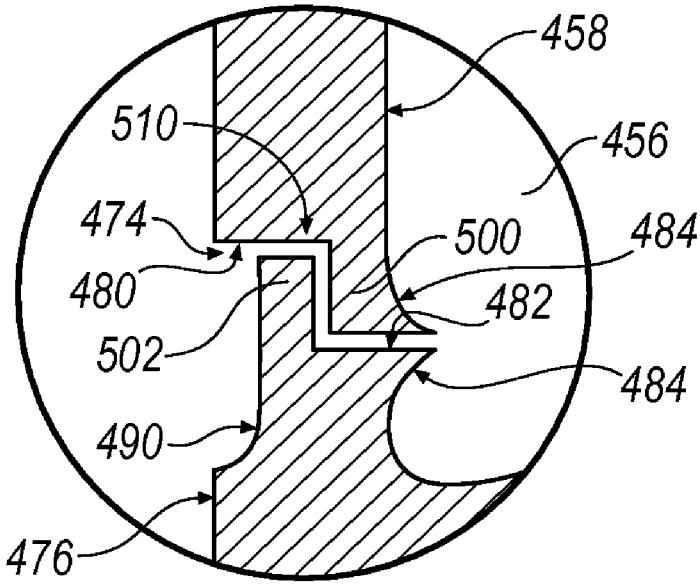
FIG. 6 is an alternative illustration of FIG. 2A.

Turning now to FIG. 6, an alternative example of baffle 510 is shown. Baffle 510 is provided in combination with a deflector 484 along both of the upper annular passageway surface 480 and the lower annular passageway surface 482. A J-shaped groove 490 is also included along the along the outer piston surface 476. The baffle 510, the deflector 484 and the J-shaped groove 490 used together as illustrated results in a minimum amount of fluid flowing from the cooling gallery 456 to the outer piston surface 476.

Figure 7:
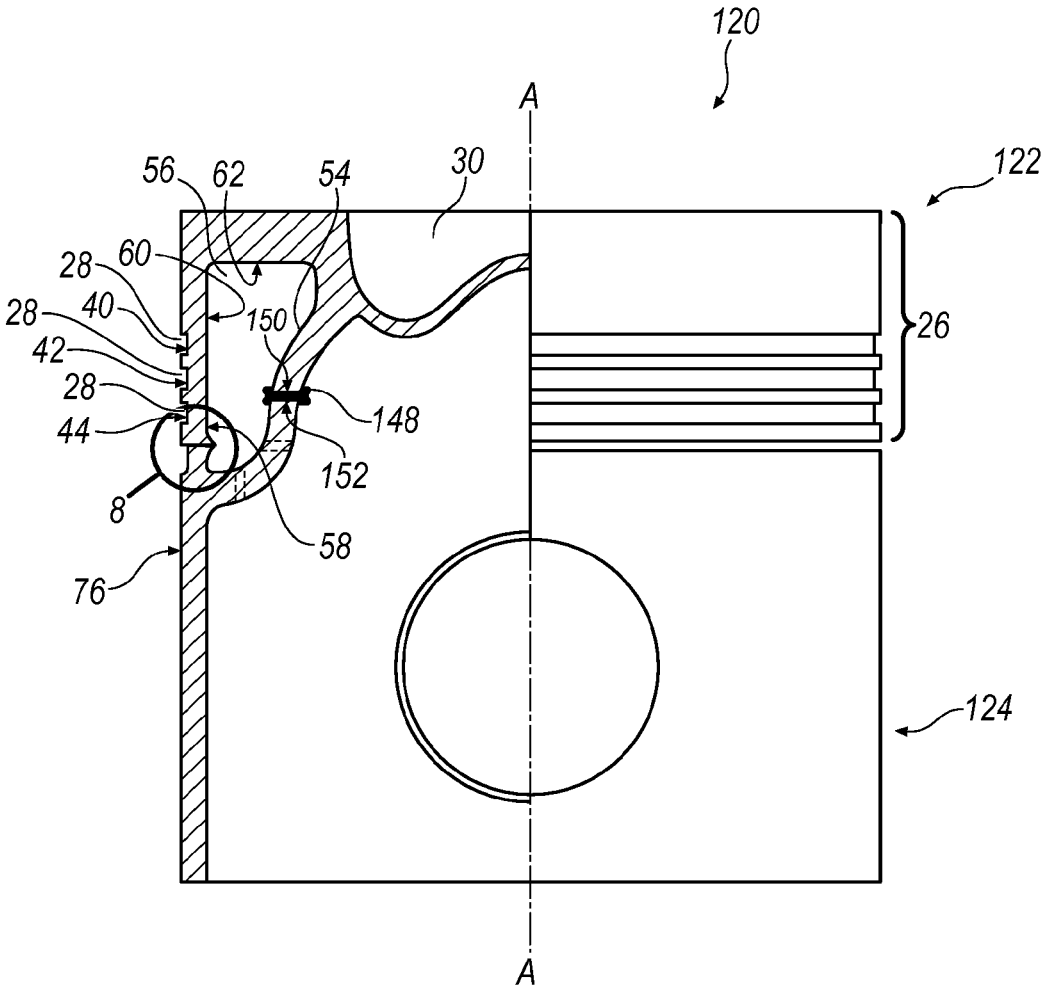
FIG. 7 is a partial cross sectional view of a piston including a piston crown and piston skirt engaged with a predetermined force.
Figure 8:
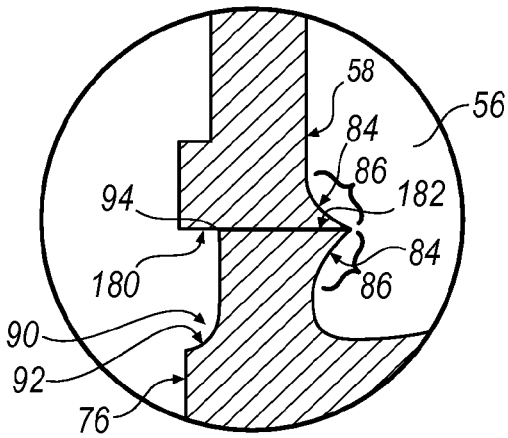
FIG. 8 is an enlarged view of Region 8 in FIG. 7.

Turning now to FIGS. 7 and 8, a piston 120 is illustrated. Piston 120 includes a piston crown 122 and a piston skirt 124 that are secured together. As shown in FIG. 7, piston crown 122 and piston skirt 124 are secured via a weld 148 that joins a lower mating surface 150 of piston crown 122 and an upper mating surface 152 of piston skirt 124. Piston crown 122 and piston skirt 124 may be secured by any other method, e.g., by providing complementary threading on piston crown 122 and piston skirt 124 that allow for engagement therebetween.

As best seen in FIG. 8, piston crown 122 and piston skirt 124 are secured such that a crown annular surface 180 and a skirt annular surface 182 are generally in abutment. Further, piston crown 122 and piston skirt 124 are secured such that each of crown annular surface 180 and skirt annular surface 182 are preloaded against each other with a predetermined force. In other words, the mechanical joining of piston crown 122 and piston skirt 124 generally pushes crown annular surface 180 and skirt annular surface 182 against each other, such that the crown annular surface 180 and skirt annular surface 182 remain in abutting engagement with each other. In other words, a predetermined force may act generally in a longitudinal direction of the piston 120, e.g., generally parallel to axis A-A, thereby urging each of the crown and skirt annular surfaces 180, 182 into engagement. This predetermined force or load may also result in a very slight elastic deformation of the outer walls of piston 120, e.g., annular ring belt wall 60, although preferably not to an extent that would potentially interfere with the operation of piston 120 within a cylinder into which it is installed. The crown and skirt annular surfaces 180, 182 may be urged against one another during an assembly operation of piston 120, e.g., during welding or securement by complementary threading of piston crown 122 and piston skirt 124, as described further below. Accordingly, although crown annular surface 180 and skirt annular surface 182 are not permanently secured directly to each other, they remain in urged abutment by the predetermined force, thereby substantially eliminating any fluid flow from a cooling gallery 156 of piston 120 through an interface between crown annular surface 180 and skirt annular surface 182 to an outer surface 76 of the piston 120.

As shown in FIG. 8, a deflector 84 may be provided on either or both of the crown and skirt annular surfaces 180, 182, such that the deflectors 84 generally act in concert with the abutment of the crown and skirt annular surfaces 180, 182 by the predetermined force to substantially reduce or eliminate flow of cooling fluid out of the cooling gallery 56 of piston 120. In other words, the deflectors 84 of piston 120 generally operate to direct fluid away from the interface between crown and skirt annular surfaces 180, 182, and the preloaded abutment of the crown and skirt annular surfaces 180, 182 generally prevents any fluid that nonetheless does reach the interface between the crown and skirt annular surfaces 180, 182 from escaping therebetween. Accordingly, flow of cooling fluid out of cooling gallery 56 to an outer surface of the piston 120, e.g., outer surface 76, is substantially reduced or eliminated.

Figure 9:
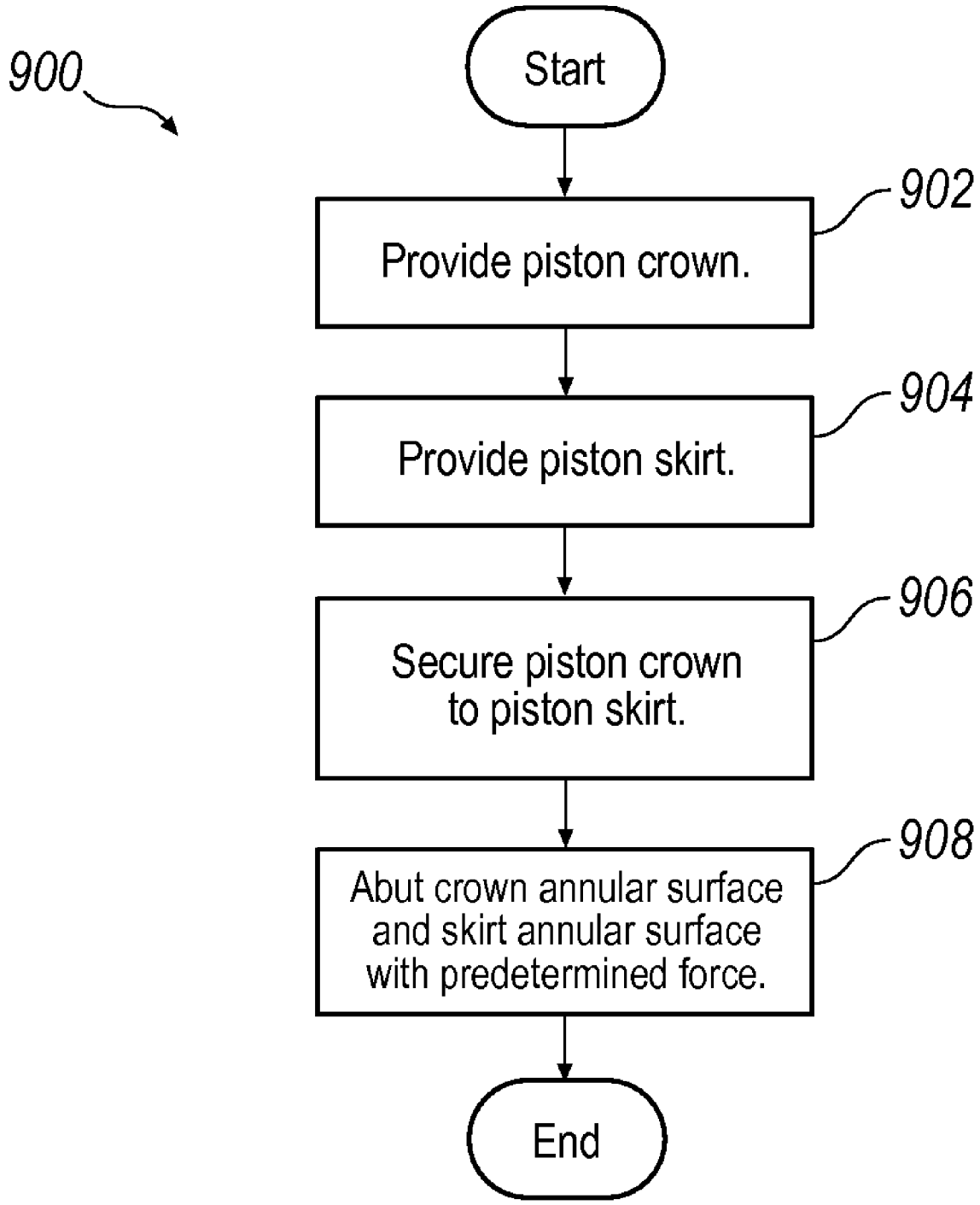
FIG. 9 is a process flow diagram of a method for assembling a piston.

Turning now to FIG. 9, a process 900 for assembling piston 120 is illustrated. Process 900 may begin at step 902, where a piston crown is provided having a crown annular surface and a crown interior surface. For example, as described above, a piston crown 22 or 122 may be provided having an upper annular surface 80 or 180 and a crown interior surface that cooperates with a skirt interior surface to form a cooling gallery surface 54. Further, upper annular surface 180 may extend into a cooling gallery 56 of the piston to define a deflector 84. Process 900 may then proceed to step 904.

In step 904, a piston skirt is provided including a skirt annular surface and a skirt interior surface. In one example, a piston skirt 24 or 124 may be provided that has a lower annular surface 82 and an interior surface that cooperates with the crown interior surface to form a cooling gallery surface 54. Process 900 may then proceed to step 906.

In step 906, the piston crown and skirt are secured to each other, such that the crown interior surface cooperates with the skirt interior surface to define a cooling gallery and a cooling gallery surface within the piston. For example, the piston crown 22 and skirt 24 may be secured together via a friction welding operation, or any other mechanical joining method, e.g., by providing complementary threading on each of piston crown 22 and skirt 24 for engagement therebetween. Further, as described above, each of the piston crown 22 and skirt 24 may have an interior surface that cooperates with other to form a cooling gallery surface 54. Process 900 may then proceed to step 908.

In step 908, the crown annular surface and the skirt annular surface are abutted with a predetermined force, wherein the predetermined force generally maintains the crown annular surface and skirt annular surface in abutment, thereby generally limiting fluid flow from the cooling gallery to an outer surface of the piston. For example, in embodiments where a piston crown 122 and a piston skirt 124 are welded together, such as by friction welding, the piston crown 122 and piston skirt 124 may be compressed or otherwise urged against each other generally immediately after the welding operation, while the weld is still hot or malleable. Thus, any gap that may exist between a crown annular surface 180 of the piston crown 122 and a skirt annular surface 182 of the piston skirt 124 is at least diminished, and even eliminated entirely as the crown and skirt annular surfaces 180, 182 are brought into abutment or are otherwise engaged. Further, the piston crown 122 and piston skirt 124 may be held in such abutment, such that as the weld cools or hardens the crown and skirt annular surfaces 180, 182 remain abutted with the predetermined force applied to the piston crown 122 and piston skirt 124 during assembly. This abutment with the predetermined force or preload between the crown and skirt annular surfaces 180, 182 thus substantially or entirely closes a gap between the crown and skirt annular surfaces 180, 182, thereby substantially eliminating losses of cooling fluid from a cooling gallery 56 of the piston 120 by way of any gap between the crown and skirt annular surfaces 180, 182.

In embodiments where the piston crown 122 and piston skirt 124 are secured to one another by complementary threading on each of the piston crown 122 and piston skirt 124, one of the piston crown 122 and piston skirt 124 may be turned relative to the other during the securing operation, until the crown and skirt annular surfaces 180, 182 are brought into abutting engagement, thereby applying the predetermined force or load between the crown and skirt annular surfaces 180, 182.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A piston for an internal combustion engine, comprising:

a piston crown including a crown annular surface and a crown interior surface; and a piston skirt including a skirt annular surface and a skirt interior surface, the crown interior surface cooperating with the skirt interior surface to define a cooling gallery and a cooling gallery surface within the piston;

wherein the crown annular surface and the skirt annular surface cooperate to form an annular passageway, the annular passageway allowing for fluid communication between an outer surface of the piston and the cooling gallery, the annular passageway defining an entrance to the cooling gallery;

wherein at least one of the crown annular surface and the skirt annular surface extend away from the outer surface of the piston and into the cooling gallery to form a deflector along the cooling gallery surface, the deflector extending to the entrance, thereby limiting fluid flow from the cooling gallery to the outer surface of the piston.

2. The piston as recited in claim 1, wherein the deflector includes one of a generally triangular, a rectangular, and a generally semi-circular profile.

3. The piston as recited in claim 1, wherein the annular passageway extends from a ring belt portion of the outer piston surface.

4. The piston as recited in claim 1, wherein the crown annular surface and the skirt annular surface each extend away from the outer surface of the piston and into the cooling gallery to form the deflector.

5. The piston as recited in claim 1, wherein the annular passageway extends about a circumference of the piston.

6. The piston as recited in claim 1, wherein the piston crown includes an upper mating surface and the piston skirt includes a lower mating surface, the upper and the lower mating surfaces being fixedly joined to define a wall of the cooling gallery.

7. The piston as recited in claim 1, wherein the piston crown and the piston skirt are fixedly joined together by one of a friction weld, a beam weld, a laser weld, and a mechanical fastener.

8. The piston as recited in claim 1, further including a generally J-shaped groove defining a ledge along the outer surface of the piston and located between an outer edge of the skirt annular surface and the outer piston surface, the J-shaped groove configured to retain fluid between the outer surface of the piston and a cylinder wall.

9. The piston as recited in claim 1, wherein the crown interior surface includes a crown interior projection and the skirt interior surface includes a skirt interior projection inverted relative to the crown interior projection;

wherein the crown interior projection cooperates with the skirt interior surface and the skirt interior projection cooperates with the crown interior surface to form a baffle configured to limit fluid flow from the cooling gallery to the outer surface of the piston.

10. The piston as recited in claim 1, wherein the annular passageway includes an angled portion configured to limit fluid flow toward the outer piston surface.

11. The piston as recited in claim 1, wherein at least one of the crown annular surface and skirt annular surface extends generally perpendicular to an axis of the piston.

12. A piston for an internal combustion engine, comprising:

a first interior surface, the first interior surface defining at least a portion of a cooling gallery of the piston;

a first annular surface defining at least a portion of an annular passageway of the piston that allows for fluid communication between an outer surface of the piston and an entrance to the cooling gallery defined by the annular passageway; and a first deflector located along the first interior surface and extending to the entrance to the annular passageway; the deflector configured to extend into the cooling gallery to generally limit fluid flow from the cooling gallery to the outer surface of the piston.

13. The piston as recited in claim 12, further comprising a second annular surface cooperating with the first annular surface to define the annular passageway.

14. The piston as recited in claim 13, wherein the second annular surface extends inwardly toward the axis of the piston to form a second deflector along the cooling gallery surface at the annular passageway for further limiting fluid flow from the cooling gallery to the outer surface of the piston.

15. The piston as recited in claim 12, further including a generally J-shaped groove defining a ledge along the outer surface of the piston and located between an outer edge of the first annular surface and the outer piston surface, the J-shaped groove configured to retain fluid between the outer surface of the piston and a cylinder wall.

16. The piston as recited in claim 12, further comprising a first interior projection; and a second interior projection inverted relative to the first interior projection;

wherein the first interior projection corresponds with the second interior projection to form a baffle configured to generally limit fluid flow from the cooling gallery to the outer surface of the piston.

17. The piston as recited in claim 12, wherein the annular passageway includes an angled portion configured to limit fluid flow toward the outer piston surface.

18. The piston as recited in claim 12, wherein the first annular surface extends generally perpendicular to an axis of the piston.

19. A method of assembling a piston, comprising:

providing a piston crown having a crown annular surface and a crown interior surface;

providing a piston skirt including a skirt annular surface and a skirt interior surface;

welding the piston crown to the piston skirt, wherein the crown interior surface cooperates with the skirt interior surface to define a cooling gallery and a cooling gallery surface within the piston; and abutting the crown annular surface and the skirt annular surface with a predetermined force, wherein the predetermined force generally maintains the crown annular surface and skirt annular surface in abutment, thereby generally limiting fluid flow from the cooling gallery to an outer surface of the piston, wherein abutting the crown annular surface and the skirt annular surface with the predetermined force includes compressing the piston crown and the piston skirt against each other before a weld between the piston crown and piston skirt is hardened.

20. The method as recited in claim 19, wherein at least one of the crown annular surface and the skirt annular surface extend away from the outer surface of the piston and into the cooling gallery to form a deflector along the cooling gallery surface.

21. The method as recited in claim 19, further comprising establishing at least one of the crown annular surface and skirt annular surface as extending generally perpendicular to an axis of the piston.

22. The method as recited in claim 19, wherein abutting the crown annular surface and skirt annular surface includes elastically deforming an outer wall of the piston.

23. A piston for an internal combustion engine, comprising:

a piston crown including a crown annular surface and a crown interior surface; and a piston skirt including a skirt annular surface and a skirt interior surface, the crown interior surface cooperating with the skirt interior surface to define a cooling gallery and a cooling gallery surface within the piston;

wherein the crown annular surface and the skirt annular surface are abutted against each other with a predetermined force, thereby generally maintaining the crown annular surface and skirt annular surface in abutment and generally limiting fluid flow from the cooling gallery to an outer surface of the piston;

wherein at least one of the crown annular surface and the skirt annular surface extend away from the outer surface of the piston and into the cooling gallery to form a deflector along the cooling gallery surface adjacent the annular passageway for limiting fluid flow from the cooling gallery to the outer surface of the piston.

24. The piston as recited in claim 23, wherein the piston crown and piston skirt are mechanically fastened to each other at a first interface to provide the predetermined force between the crown annular surface and skirt annular surface at a second interface, said first and second interfaces being spaced away from each other.

25. The piston as recited in claim 23, wherein at least one of the crown annular surface and skirt annular surface extends generally perpendicular to an axis of the piston.

* * * * *